United States Patent [19]

Schumacher

[11] 3,944,773

[45] Mar. 16, 1976

[54] AC SWITCH WITH CANTELEVER CONTACT AND BALANCE SPRINGS

[76] Inventor: Walter C. Schumacher, Warwick, R.I.

[22] Filed: Mar. 28, 1974

[21] Appl. No.: 455,834

[52] U.S. Cl. ..... 200/293; 200/281; 200/284; 200/67 G; 200/6 BB

[51] Int. Cl.[2] ..... H01H 9/08

[58] Field of Search ..... 200/284, 339, 281, 153 LB, 200/153 G, 293, 6 R, 6 B, 6 BB, 6 C; 29/622

[56] References Cited

UNITED STATES PATENTS

| | | | |
|---|---|---|---|
| 3,030,479 | 4/1962 | Ehrlch et al. | 200/284 X |
| 3,036,171 | 5/1962 | Wiley | 200/284 X |
| 3,082,303 | 3/1963 | Wiley | 200/339 X |
| 3,409,749 | 11/1968 | Judd et al. | 200/67 G |

*Primary Examiner*—Robert K. Schaefer
*Assistant Examiner*—William J. Smith
*Attorney, Agent, or Firm*—Paul E. Rochford

[57] ABSTRACT

An alternating current switch suitable for automatic assembly is provided having an insulating housing including an open top base and a cover to close the base. The base has side openings to expose screw terminals and may have bottom openings to admit wires to push in connectors. The terminals are integral parts of contact arms within the housing. The contact arms as well as a balance spring are held in place in the housing within side wall slots integral with the base of the housing and by bosses integral with the cover. The balance spring and a movable contact arm are shaped to bear against cam portions of a toggle.

The cover is provided with bearings to hold the toggle at its trunions in pivoting relation and is provided with a top opening through which the trigger of the toggle extends to the switch exterior. Ease of assembly is achieved due to the small number of parts and the simplicity of the individual parts so that the switch may be assembled quickly by hand or in automatic assembly equipment of relatively low cost.

The movable contact is formed from a single metal strip including wire terminal and electrical contact and has a long operational life.

6 Claims, 10 Drawing Figures

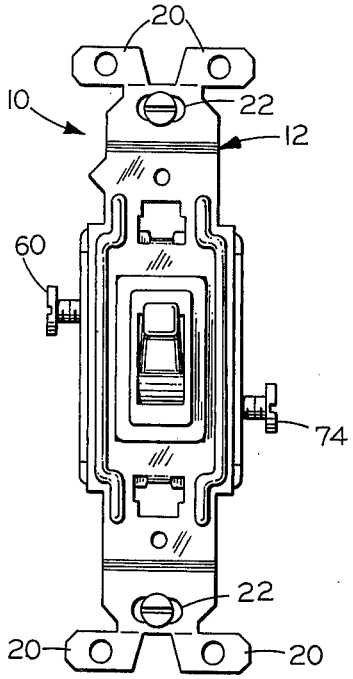
FIG. 1
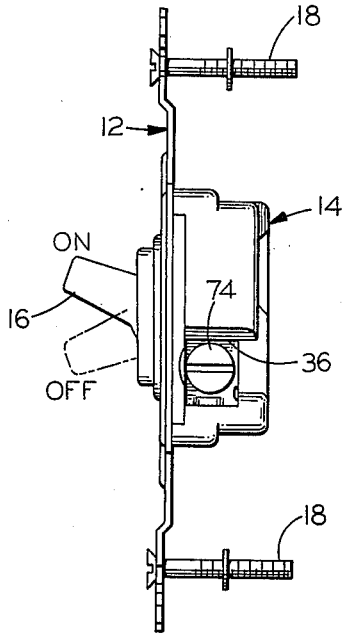
FIG. 2
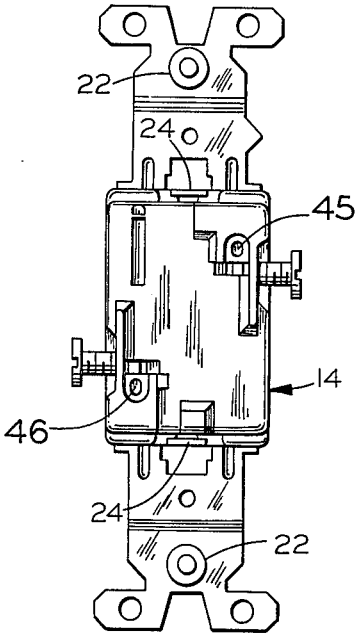
FIG. 3
FIG. 4
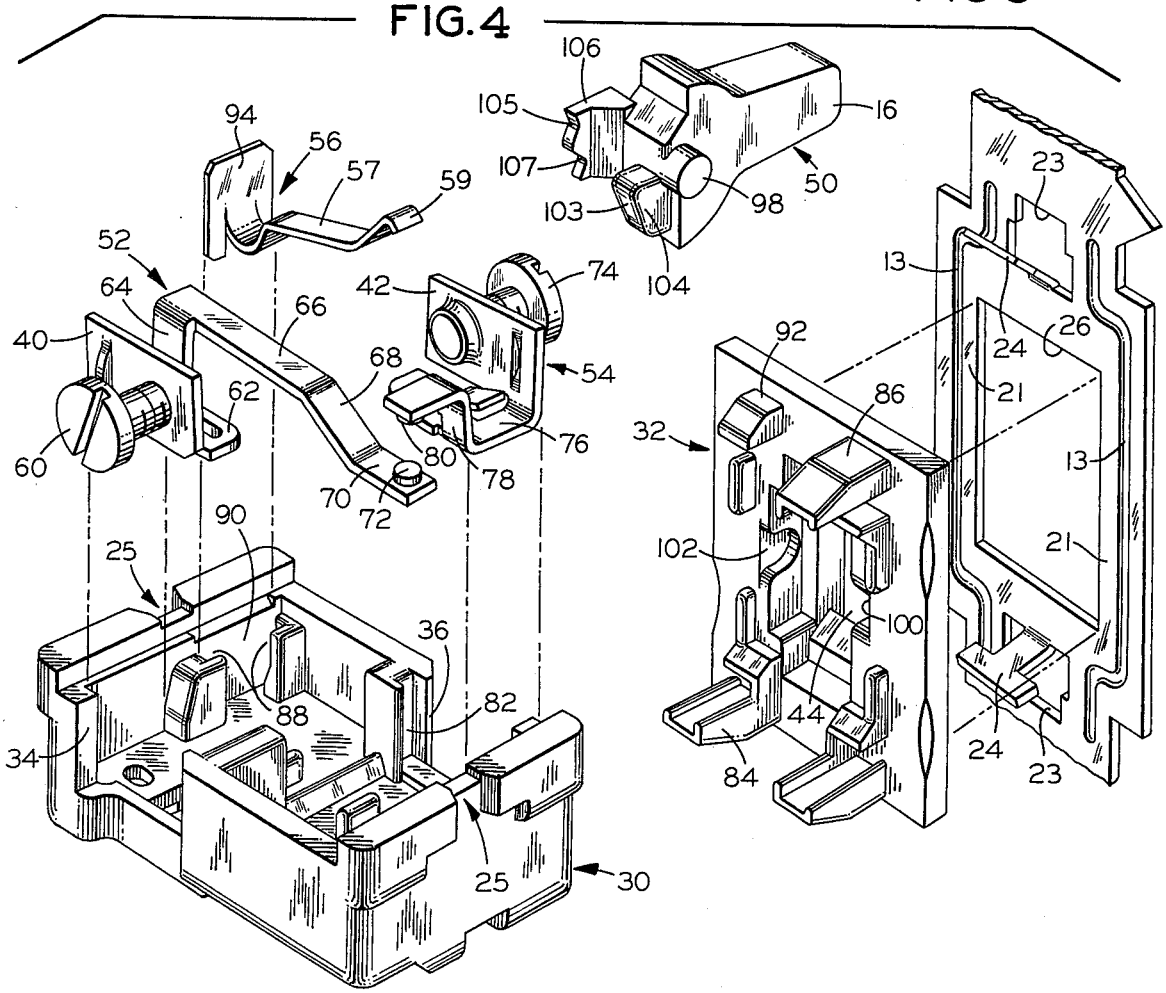

AC SWITCH WITH CANTELEVER CONTACT AND BALANCE SPRINGS

CROSS-REFERENCE TO RELATED APPLICATION

This application includes a screw terminal such as is described and claimed in copending application of Harry Triantafellow and Ralph Graves, Ser. No. 375,185, filed June 29, 1973, and assigned to the same assignee as this application.

BACKGROUND STATEMENT

The present invention relates to switch mechanisms and particularly to a switch mechanism of small size having an extended useful life, and suitable for assembly by automated equipment.

It is well-known that alternating current switches constitute the principle form of switches employed in the switching of current to lighting fixtures and in other branch cirucit applications within residences and other buildings. The branch circuit within a home and in many other buildings normally carries 15 to 20 amperes. It usually extends from the service entrance where the electric power enters the building. Normally such a branch cirucit is protected by a single fuse or circuit breaker at the service entrance of the building.

The normal load on such a branch cirucit is of the order of 15 amperes or less, particularly where the load is lighting fixtures such as are conventionally controlled by AC switches within conventional residences. Because of the very large number of such switches in homes and other buildings, it is highly desirable that these switches by manufactured at relatively low cost although the switch must nevertheless provide fully reliable switching action and must be fully capable of performing the switching operation involving the on-off control of the 15 amperes of power at the conventional 120 volts. The Underwriters' Laboratory normally makes a requirement that such switches for use in home applications be capable of controlling some 30,000 on-off switching operations. This testing by Underwriters' Laboratories is done under overload conditions according to Standard Test Number UL20. Further, it is known that it is desirable that a switch have not only high reliability and extended life but also be relatively small in size. The small size is desirable because it is installed in a normal wall box which may measure 3 inches (7.62 cm.) in height by 2 inches (5.08 cm.) in width and 1-½ (3.81 cm.) to 2 (5.08 cm.) inches in depth. Further there are shallow wall boxes for installation with wall paneling and the like which have a depth of only 1 inch. Accordingly there is a distinct advantage in having a reliable AC switch which will occupy a fairly small part of this wall box enclosure so that there will be adequate room in the box for the lengths of wire stored there due to the needs associated with conventional wiring practice as well as wire nuts and other elements employed in connection with properly wiring a switch to control a load in a branch circuit.

Another feature which is sought in AC switches is a low manufacturing cost and this cost is of course made up of a material cost and labor cost. Where the switch has relatively low material content and where the switch is readily assembled the manufacturing cost of the overall device can also be relatively low. The cost of assembly can be greatly benefitted if the structure of the switch is such that it can be assembled by automated equipment. However, the building of an automatable switch requires that the switch structure itself be fairly simple and that the individual parts be easy to assemble in a reliable fashion. The smaller the number of parts and the simpler the individual parts to make up a switch, the greater is the likelihood that a machine to assemble the switch can be designed and can be produced at a reasonable cost.

Accordingly, it will be seen from the foregoing that the combination of properties desirable in a switch is relatively hard to achieve inasmuch as some of the criteria of a switch contradict others and achievement of the overall favorable performance is a matter of some technical difficulty. For example, where a switch is to be reliable it must have a fairly controlled dimensional spacing of its various parts and particularly of the parts which are to perform the movement which results in the switching action. However, where the switch and the elements of the switch are of simple design and thus suitable for automated assembly, it is not easy to achieve the close dimensional control of the moving parts such as will ensure reliable switching action. The automated assembly of a switch is most easily achieved where the dimensions of the product and of the component parts are precisely controlled, but such control is difficult where the component parts themselves are quite simple and where their assembly is also quite simple as by reliance upon gravity.

A number of switch articles which may have one or more of the features as above noted have been known heretofore and illustrative switches are those taught by U.S. Pat. Nos. 2,578,494, 2,962,572, and 3,165,614. Other switches having still other features and combinations of features such as those shown in U.S. Pat. Nos. 3,283,105 and 3,030,479 are also known in the switch art. However, these reference patents do not contain a unique combination of all of the features discussed above.

There is also a general outward resemblance between a switch described in U.S. Pat. No. 3,532,846 and the switch product taught in this application both of which are assigned to the same assignee. However, the switch of U.S. Pat. No. 3,532,846 does not have the same internal elements as the switch structure taught below nor does it have the same features, such as automatability, or functional properties as the switch structure taught and claimed herein.

OBJECTS OF THE INVENTION

It is accordingly one object of the present invention to provide an alternating current switch at relatively low manufacturing cost.

Another object is to provide a switch which has a long operational life expectancy.

Another object is to provide a switch having a low number of parts of relatively simple construction.

Another object is to provide a switch having elements which can be easily assembled and which assembly is therefore automatable in relatively simple automation equipment.

Another object is to provide a switch having a trigger motion which has a soft stop at each end of the stroke of the trigger.

Still another object of the present invention is to provide a switch which has a combination of a number of the above noted desirable performance characteristics and attributes to facilitate manufacture.

Other objects and advantages of the invention will be in part pointed out and in part self-evident in the description which follows. SUMMARY OF THE INVENTION A switch is provided having an insulating housing including a base and cover adapted to be assembled together and attached to a mounting strap for mounting the switch in a wall box. A toggle mechanism within the switch includes a toggle having a trigger extending through an opening in the cover of the housing.

The toggle is pressed by a leaf spring within the housing at cams thereof to urge trunions into trunion wells in the cover of the housing to permit pivoting of the toggle about the trunions.

The leaf spring is held at one end thereof at a wall of the housing partly by a slot in the base and partly by a depending boss of the cover. The leaf spring presses at its other end against cams formed integrally with and extending from the toggle.

The cam against which the leaf spring presses has two spaced detents and the end of the leaf spring in contact with the cam is bent to conform generally to the outer surface of each of the detents. The inner surfaces of the detents join at a ridge which gives the toggle the over-center motion as the toggle is pivoted.

The switch includes also a movable and a stationary electrical contact. The contacts are held at wall portions of the housing by grooves in the housing base and bosses depending from the housing cover. Wire attachment means are located at the held ends of the contacts. The movable contact is formed of a single piece of metal strip and a movable contact arm portion thereof extends below a cam of the toggle and is moved in response to pivoting of the toggle. The movable contact arm is attached at its held end at a side thereof to a torsion bar formed integrally with a portion of the strip and the torsion bar is supported at its opposite end from the wire attachment means with which it is integral.

BRIEF DESCRIPTION OF THE DRAWING

FIG. 1 is a front elevation of the exterior of a switch.

FIG. 2 is a side elevation of the switch illustrated in FIG. 1 with a trigger illustrated in the ON position and in phantom in the OFF position.

FIG. 3 is a rear elevation of the switch illustrated in FIG. 1.

FIG. 4 is an exploded perspective view of the switch of FIG. 1 with parts at the right portion of the Figure set at an angle with reference to the parts at the left side of the Figure.

FIG. 8 is another fragmented sectional view of the switch of FIG. 1 illustrating the relationship of the switch housing and toggle relative to the contact arms and illustrating the toggle in the position which permits the arms to make contact and the switch to be ON.

DESCRIPTION OF THE PREFERRED EMBODIMENT

Figure 5:
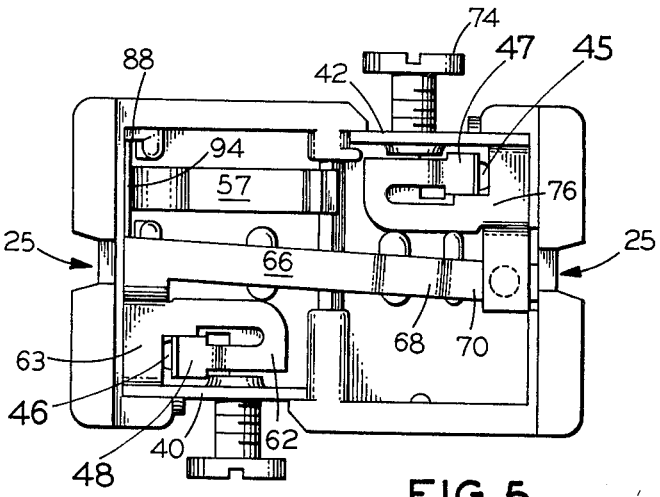
FIG. 5 is a top plan view of the base of the switch illustrated in FIG. 4 with metal parts in place in the base.

A switch 10 includes as its external components a mounting bracket 12, an insulating housing 14, and a trigger 16 manipulated into the ON and OFF positions, illustrated in FIG. 2, in operation of the switch.

The mounting bracket 12 is formed from a steel strip and it has severable end plaster ears 20, mounting screw slots 22, locking tongues 24 bent down out of the strip, and a central opening 25 defined by side runners 21 straddling the insulating housing 14. Mounting screws 18 extend through slots 22 of strap 12 to permit mounting the overall switch 10 into a conventional wall box not shown.

The insulating housing 14 is made up of a box shaped base 30 and a cover 32 adapted to fit the top of the base 30 and close it. Base 30 is provided with two side openings 34 and 36 into which screw terminal plates 40 and 42 are inserted and held.

Cover 32 has a central opening 44 through which trigger 16 of toggle 50 extends to the switch exterior to permit manual manipulation.

Turning now to the internal portions of the switch, these are exhibited in an angled exploded view in FIG. 4. By angled exploded view is meant that the elements on the right side of FIG. 4 are turned at an angle relative to the elements on the left side of the Figure. If the elements were all shown in a straight line exploded view the toggle 50 would be located above the left hand side of the Figure, as would the cover 32 and the mounting strap 12. Also these last three elements would be seen in a straight line exploded view turned at an angle of about 90° from their positions as illustrated in FIG. 4. Further they would be seen from a perspective angle illustrating the upper surfaces of the elements rather than the lower surfaces as actually illustrated in the FIG. 4.

Referring particularly to the left half of FIG. 4, three metal elements are poised in a pre-assembly position above base 30. These elements are movable contact 52, stationary contact 54 and balance spring 56.

Movable contact 52 includes a screw terminal plate 40, a screw 60, a wire terminal 62, torsion bar 64, and a spring arm 66, including beveled section 68 and end section 70. A silver contact 72 is provided in the end section 70.

The stationary contact 54 includes screw terminal plate 42, screw 74, wire terminal 76, and contact bearing arm 78. Contact 80 is a silver contact provided in arm 78.

The base 30 of housing 14 receives the three described elements in slots and grooves formed for this purpose integrally in the base 30. Screw terminal plate 42 and wire terminal 76 for example, nest into place in the right hand corner of base 30 as illustrated in FIG. 4. One edge of terminal plate 42 is inserted into and held in edge groove 82. Stationary contact 54 is also partly held in place in the base 30 by a boss 84 depending from that corner of cover 32 positioned above the right corner of base 30 when the switch housing is assembled.

Screw terminal plate 40 and wire terminal 62 nests in the corner of base 30 at the left side of the base 30 as illustrated in FIG. 4. Boss 86 formed integrally with and depending from cover 32 helps hold movable contact 52 in place in the switch housing.

Balance spring 56 is positioned into place in base 30 in the slots 88 formed integrally in base 30 at end wall 90. Boss 92 formed integrally with cover 32 holds the upper portion of the held end 94 of balance spring 56.

Cover 32 thus has bosses which cooperate with the metal elements positioned in base 30 so that the elements are held precisely in operating position within the switch housing once the switch housing and toggle are assembled together. This is in fact one of the features of this invention. A precise operating location and retention of the operating parts of the switch is achieved by building the metal parts so that they may be:

1. dropped easily into loosely conforming slots and channels in base 30 and
2. retained within an insulating housing in operating position based on a cooperation between the metal elements and the parts of the housing including the base of the housing, and the toggle and cover assembled to the base.

In part, the importance of the use of both cover and base, as well as the toggle, in positioning and holding the operating metal elements of the switch, is that it permits the metal parts to be placed into the base without forcing or driving of any parts into place or otherwise screwing or attaching them into base 30. The result of the relatively easy fit of the metal parts in base 30 is that the assembly of the metal parts and base may be automated inasmuch as the individual parts may be placed in their respective locations by a simple dropping action. Yet once the cover and toggle are assembled to the base, the result is to complete the positioning and to provide a secure retaining of the internal elements in their proper operating positions. The switch article as taught herein is accordingly highly automatable by relatively simple automatic assembly equipment. It is of course possible to automate the assembly of more elaborate or complex switch structures but the cost of the equipment which performs more complex assembly operations is higher.

On the right side of FIG. 4, the three elements, namely a toggle 50, a cover 32 and a strap 12 are illustrated in the angled exploded arrangement described above.

Portions of the cover and particularly portions which cooperate with the internal metal elements of the switch structure are described above. The cover also cooperates with the toggle 50 in a largely conventional manner. In particular, the trunions 96 and 98 of the toggle cooperate with the conforming trunion wells 100 and 102 in the underside of cover 32 on opposite sides of trigger opening 44 to permit pivoting of the toggle.

Considering the toggle next in greater detail, the portion confronting the internal metal elements of the switch is provided with two cams. A first cam 104 has a generally inclined lower surface 103 and a second cam 106 has a set of detents 105 and 107 at its lower surface. The term lower surfaces here designates surfaces reaching lowest into the base 30 in the switch housing 14 when the switch is fully assembled and in the position of base 30 in FIG. 4. The lower surfaces of cams 104 and 106 are those which actually engage and act on movable contact 52 and balance spring 56 and specifically on the extended arm portions 66 and 57 respectively of these elements. This contact occurs as the trigger 16 of toggle 50 is manipulated as explained more fully below.

Strap 12, shown with its ends truncated in FIG. 4, has two locking tongues 24 formed from the metal strip of the strap and these tongues 24 are bent out of the plane of the strap to engage the conforming latches 25 at opposite ends of base 30 of insulating housing 14. Strap 12 also has a strengthening rib 13 extending along the side runners 21 of the opening 25 and adjacent the openings 23 containing latching tongues 24.

The screw terminal of contact 42 including screw 60 and plate 40 as well as the screw terminal of contact 54 including plate 42 and screw 74 may be conventional screw terminals or may be the special screw terminals adapted for securing aluminum wire described in copending U.S. application for patent of Harry Triantafellow and Ralph Graves, Ser. No. 375,185, filed June 29, 1973, and assigned to the same assignee as this application.

The wire terminals 62 and 76 of contacts 52 and 54 respectively are the form of contacts essentially as taught and described in U.S. Pat. No. 3,532,846, assigned to the same assignee as this application and do not form part of this invention. Wire entry ports 45 and 46 are aligned with wire locking tongues 47 and 48 and provide means for connecting power supply wires to the contacts of the switch 10.

Figure 8:
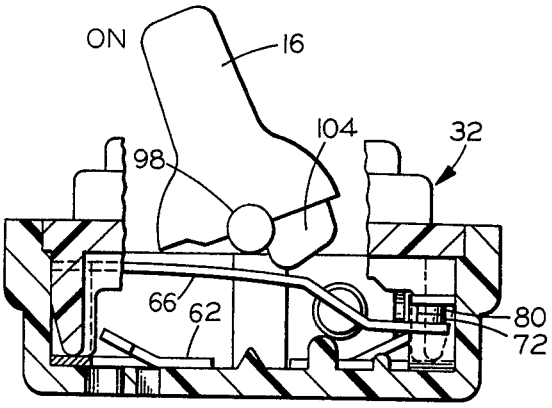

We consider next the ON-OFF operation of the switch. The primary element in effectuating the switch operation from its ON to OFF condition, and vice versa, is the movement of movable contact 52. When spring arm 66 of contact 52 is depressed by pressure of cam 104 bearing on the spring arm 66, the contacts 72 and 80 are separated into the position illustrated in FIG. 9. Return of the cam 104 to a position out of contact with spring arm 66 as illustrated in FIG. 8 brings the silver contacts 72 and 80 back into engagement and puts the switch into the ON position.

Figure 6:
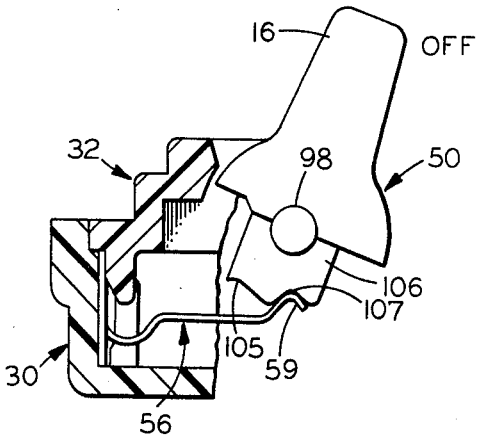
FIG. 6 is a fragmented sectional view of internal parts of the switch of FIG. 1 emphasizing the relation of a spring element to the switch housing and to the toggle, with the toggle in the OFF position.
Figure 7:
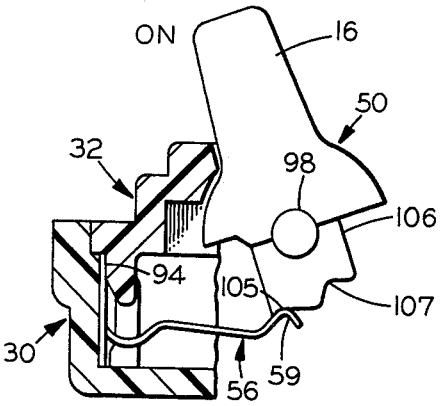
FIG. 7 is a view similar to that of FIG. 6 but illustrating the toggle in a different position relative to the springs, in this case the ON position.

While the cam 104 is operating on spring arm 66 to position it, the cam 106 is operating on balance spring 56. Spring 56 has a held end 94, an outwardly extending spring arm 57 and a bent end 59. Cam 106 has two detents 105 and 107 which engage bent end 59 of balance spring 56. The detents 105 and 107 have adjoining or inner sides which meet at a crest and the overcenter motion of the toggle is due to the movement of the bent end 59 up to and over this crest. The cooperation between toggle 50 and balance spring 56 is illustrated in FIGS. 6 and 7 for both the ON and the OFF positions of the toggle. In the OFF position illustrated in FIG. 6, the bent portion 59 of balance spring 56 rests in the relatively deeper detent 107 of the set of detents in cam 106.

One feature of the balance spring and cam combination of the switch of this invention is that there is a controlled movement of the toggle mechanism to give both a positive overcenter action and also a soft stop to the stroke of the trigger at each end of the stroke. This soft stop is accomplished without use of auxilliary rubber bumper or bumper parts of a similar resilient material. Thus when the trigger 16 reaches the OFF position illustrated in FIG. 6, the detent 59 of the balance spring 56 nests into the deeper detent 107 and the trigger comes to an at rest position because of the nesting of the balance spring into the detent. An overtravel of the trigger past its normal at rest OFF position, illustrated in FIG. 6, is resisted due to the additional spring pressure developed as the bent portion 59 moves out of the detent 107 as the trigger moves beyond the at rest position. Due to the cooperation of the balance spring and the detent there is accordingly a soft stop to the movement of the toggle as the spring comes into its OFF position in the detent 107. Any additional movement of the trigger is resisted by the increased pressure developed between the bent portion 59 and the outer inclined surface of detent 107, and this additional pressure urges the toggle back to its at rest position.

Similarly at the opposite end of the stroke, when the trigger moves to the ON position the bent end 59 comes into conforming contact with the more shallow detent 105 and particularly with the outer surface thereof. Detent 105 is, as illustrated, also formed integrally with the cam 106 of toggle 50. As the trigger moves to its at rest ON position, the toggle at that point is pivoted to an angle where there is a generated significant frictional and spring contact pressure between the outer wall of the detent 105 and the surface of bent end 59. This contact pressure increases as the toggle tends to go through and past the rest position and the increased pressure tends to return the spring to its at rest position resulting in a soft stop to the trigger movement.

One of the features of the switch mechanism described is the relatively long useful life of the switch and particularly of the moving elements thereof. As indicated above, the UL test requirements for a switch of this type is about 30,000 cycles under given test conditions set out in UL 20. The switch of this invention passes a more stringent Federal Specification test, W-S-896d, which requires an additional 40,000 cold lamp load cycles when combined with the UL 20 test. The switch of U.S. Pat. No. 3,532,846 referred to above was found not able to pass the Federal Specification test on a regular basis. Switches produced according to this invention go well beyond 100,000 cycles when subjected to mechanical ON-OFF testing, or what is commonly referred to as life testing, and a large proportion go beyond 200,000 ON-OFF cycles.

Normally switch life expectancy is related to the wearing out or the breaking of the moving elements of the switch structure. For example, one of the elements which gives out is the spring element, whether the spring is a leaf spring, a coil spring, or some other form of spring. The necessity for flexing the spring element with each operation of the switch leads eventually to failure, usually by cracking of the metal of the spring, and the breaking of the spring so that it can no longer function as part of the switch mechanism. By the spring here is meant a spring element in the switch which carries no current.

Also there is a flexing of the contact arm of the switch mechanism and this flexing can cause cracking and breaking of the contact cam. By the contact arm here is meant the arm which carries the electric current and which bears the silver contact. Normally in any conventional switch, the contact arm is moved to bring the silver contact to an OFF or separated position and is moved again to bring the silver contact to the joined or ON position as the toggle trigger is moved from its OFF to its ON position and back again with each switching cycle.

Figure 9:
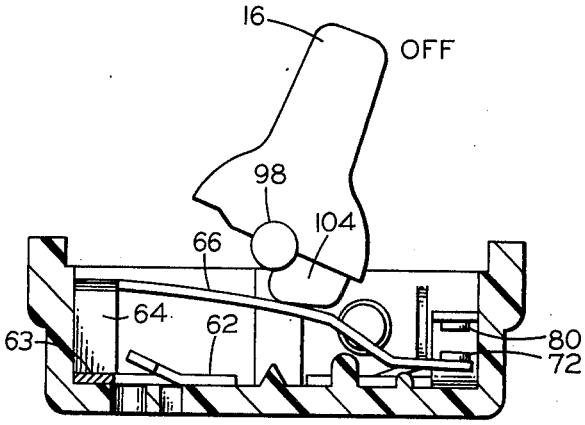
FIG. 9 is a fragmented sectional view of the switch as illustrated in FIG. 8 but with the toggle positioned to separate the contact arms into their OFF position.

In the particular case of the switch illustrated, as for example in FIG. 5, the depressing of the spring arm 66 by action of the cam 104, as illustrated in FIGS. 8 and 9, leads to an upward and downward movement of the spring arm 66 and consequently of the contact 72 mounted on the end of this spring arm. What is distinct about the switch of this invention is that the spring arm 66 is formed integrally with all the elements of entire movable contact 52 including the wire terminal 62 and screw terminal plate 40. The spring arm 66 is accordingly of a heavier stock of metal and is not a separate spring metal element which is specially treated or designed or formed. On the contrary, the metal of spring arm 66 is the very same of that of plate 40 and of wire contact 62. In fact, all elements of the contact 52 are stamped and formed from the same metal strip.

This is in contrast to many prior art switches which use a heavier metal in the portion of the contact where a screw is mounted, and a separate lighter gauge spring metal for the spring arm. Such lighter gauge arms are attached either by welding, riveting, or other means to the heavier gauge metal strip used in forming the screw terminal plate and adjacent element. Such a switch construction is taught for example in the U.S. Pat. No. 3,532,846 of W. Schumacher referred to above. What is unique about the switch structure of this invention is that there is a torsion bar 64 formed between the spring arm 66 and the base 63 of the wire contact to which the torsion bar is joined at its lower portion. The use of a torsion bar is one of the elements which is thought to account for the extended operating life expectancy of the switch structure of this invention. The mechanism thought responsible for this extended operating life is the torsional twisting and bending of bar 64. When the cam 104 acts on spring arm 66 to depress it, the torsion bar 64 joining spring arm 66 to base 63 is bent and a torsional force is applied due to the fact that bar 64 is joined to the spring arm 66 at the end of arm 66 but also at the side of the end of arm 66. No torsion would occur if the support for spring arm 66 were formed or attached at the end of arm 66 essentially as an extension of the arm but running down from the end of the arm.

One advantage of the switch as described above is that the flexing of the movable contact arm does not concentrate a stress at a particular point of the arm as for example at the juncture where a thinner member is attached to a thicker base or support member. Also flexing is not concentrated at one particular corner or bend as would be the case if arm 66 were supported from a strip similar to arm 66 but one which is simply bent down along wall 90. Stresses which lead to failure tend to concentrate at a corner at the point where bending occurs as the arm is flexed. In fact, failure of the movable contact 52 from life tests occurred in a number of tests at the juncture of torsion bar 64 with the base 63 of push-in wire terminal 62.

Figure 10:
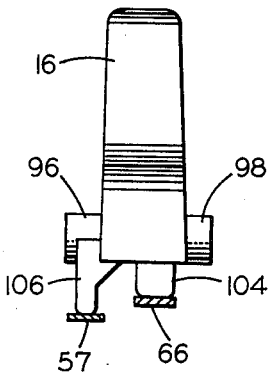
FIG. 10 is an end elevational view of the toggle of the switch illustrating contact of the cams of the toggle with respective metal elements shown in section.

In FIG. 10, a side by side sectional view of the spring arm 57 and the contact arm 66 is illustrated. The toggle 50 is shown in position above the two metal strips which it contacts. What is illustrated is schematic and is intended to display the side by side relation of the cams and of the metal members pressing aginst them. As is evident from FIG. 8, the cam 104 is not always in contact with the contact arm 66. In fact when the toggle is in the ON position, the cam 104 is separated and spaced from arm 66. In this position, bent end 59 rests in the more shallow detent 105 of cam 106. By contrast when the toggle is in the OFF position, both cams 104 and 106 are in contact with and bear against their respective metal elements. In this position, bent end 59 is nested in the deeper detent 107. One reason why detent 107 is deeper is that when spring cam 66 is deflected downward by cam 104, the spring bias of the arm urges it toward the ON position. Accordingly, the deeper detent 107 retains the bent end 59 with greater force and overcomes the return force applied to cam 104 by spring arm 66.

What is claimed as novel and desired to be secured by Letters Patent of the United States is:

1. A switch subject to automated assembly comprising:

a. an insulating housing and a mounting strap, said mounting strap being adapted to support the insulating housing when mounted in a wall box, b. said insulating housing including a box shaped base and a cover adapted to be fitted to the base to close it, c. a toggle mounted within said housing in pivoting relation, said toggle having a trigger extending in one direction through a hole in said cover and having cams extending generally in an opposite direction to press against spring biased elements in said housing, d. a movable and a stationary contact in said housing, said contacts having held ends provided with wire terminals and free ends bearing electric contacts adapted to be engaged and disengaged with the pivoting of said toggle, e. said contacts being loosely supported in the base of said housing from their held ends at wall portions of said base and said contacts being firmly held at such wall portions by bosses depending from the cover of said housing, f. a balance spring having a held end and a curved free end in contact with a cam of said toggle and applying spring bias pressure against said curved free end, and g. the held end of said balance spring being loosely supported in said base and being firmly held by bosses depending from the cover.

2. The switch of claim 1 in which the mounting strap is held to the cover of said housing by metal tongues folded from said strap into receiving latches of base of said housing.

3. The switch of claim 1 in which the toggle mounting is trunions seated in trunion wells in the cover of said housing and the spring biased elements are the movable contact and balance spring of said switch.

4. The switch of claim 1 in which the wire terminals are screw terminals for attachment of wires and the screw terminals are loosely supported at openings in the side of the housing base.

5. A switch mechanism having a long operating life:

a. said switch mechanism comprising an insulating housing including a base and cover, b. a toggle having a trigger extending through said cover and oppositely extending cams, c. a movable and a stationary contact in said housing, d. said movable and stationary contacts each having a held end and a free end and each bearing an electrical contact at the free end, e. said movable and stationary contacts having wire attachment means at the held ends thereof and proximate the walls of said housing to facilitate connection of electric supply wires to said movable and stationary contacts, f. said movable contact having an elongated arm thereof extending beneath said toggle and being aligned with a cam of said toggle to be moved in response to the pivoting of said toggle, g. the electrical contact of said elongated arm being movable into and out of electrical connection with the electrical contact of said stationary contact as said toggle is pivoted, h. the elongated arm of said movable contact being formed integrally with the other elements of said movable contact and said movable contact including a torsion bar aligned at right angles to said elongated arm and extending from a side edge of said arm at the end opposite the contact bearing end portion, and i. said torsion bar being integral with and terminating in said wire attachment means.

6. The switch of claim 5 wherein the wire attachment means includes a screw terminal loosely held at a side opening of the base of said housing, and firmly held by a boss depending from the cover of said housing.

* * * * *